US006912751B2

(12) United States Patent
Steiger et al.

(10) Patent No.: US 6,912,751 B2
(45) Date of Patent: Jul. 5, 2005

(54) EXPANSION JOINT SYSTEM FOR ACCOMMODATION OF LARGE MOVEMENT IN MULTIPLE DIRECTIONS

(75) Inventors: Debra Steiger, Orchard Park, NY (US); Paul Bradford, East Amherst, NY (US); David Kent Fugard, St. Catherines (CA); Charles Haas, Amherst, NY (US); Wayne Walter, Lockport, NY (US)

(73) Assignee: Construction Research & Technology GmbH, Trostberg (DE)

( * ) Notice: Subject to any disclaimer, the term of this patent is extended or adjusted under 35 U.S.C. 154(b) by 83 days.

(21) Appl. No.: 10/402,639

(22) Filed: Mar. 29, 2003

(65) Prior Publication Data

US 2004/0016065 A1 Jan. 29, 2004

Related U.S. Application Data

(60) Provisional application No. 60/369,291, filed on Apr. 2, 2002.

(51) Int. Cl.[7] ..... E01C 11/02; E01D 19/06

(52) U.S. Cl. ..... 14/73.1; 404/47

(58) Field of Search ..... 14/73, 73.1, 73.5; 404/47, 56, 64, 67–69, 72, 74, 87

(56) References Cited

U.S. PATENT DOCUMENTS

| | | | | | |
|---|---|---|---|---|---|
| 4,007,994 | A | * | 2/1977 | Brown | 404/69 |
| 4,030,156 | A | * | 6/1977 | Raymond | 14/73.1 |
| 4,076,440 | A | * | 2/1978 | Bertschmann | 404/69 |
| 4,080,086 | A | * | 3/1978 | Watson | 404/69 |
| 4,111,582 | A | * | 9/1978 | Tippett | 404/47 |
| 4,120,066 | A | * | 10/1978 | Leroux | 14/73.1 |
| 4,533,278 | A | * | 8/1985 | Corsover et al. | 404/65 |
| 4,784,516 | A | * | 11/1988 | Cox | 404/69 |
| 5,863,148 | A | * | 1/1999 | Shivaram | 404/28 |
| 5,887,308 | A | * | 3/1999 | Walter | 14/73.1 |
| 6,039,503 | A | * | 3/2000 | Cathey | 404/67 |
| 2003/0196400 | A1 | * | 10/2003 | Braun | 52/459 |

FOREIGN PATENT DOCUMENTS

| | | | | | |
|---|---|---|---|---|---|
| JP | 2001107303 | A | * | 4/2001 | E01C/11/02 |

* cited by examiner

*Primary Examiner*—Thomas B. Will
*Assistant Examiner*—Alexandra K. Pechhold
(74) *Attorney, Agent, or Firm*—Curatolo Sidoti Co., LPA; Joseph G. Curatolo; Salvatore A. Sidoti

(57) ABSTRACT

An expansion joint system which is provided to accommodate forces applied to highway construction during normal changes in ambient conditions, and which is also designed to withstand seismic forces and vehicular forces, which may be applied in transverse and longitudinal directions. The system includes spaced-apart transverse vehicle load bearing members which are placed in a gap defined between adjacent sections of highway construction, longitudinally extending support members positioned beneath the load bearing members, means embedded within the adjacent roadway sections that control longitudinal, transverse and vertical movement, and a mechanism for controlling the spacing between the transverse load bearing beams. Preferably, this mechanism maintains a substantially equal distance between the transverse load bearing beam members.

27 Claims, 10 Drawing Sheets

EXPANSION JOINT SYSTEM FOR ACCOMMODATION OF LARGE MOVEMENT IN MULTIPLE DIRECTIONS

CROSS REFERENCE TO RELATED APPLICATIONS

This application claims the benefit of the filing date under 35 U.S.C §119(e) of U.S. Provisional Application for Patent No. 60/369,291, filed on Apr. 2, 2002.

BACKGROUND OF THE INVENTION

The present invention relates to an expansion joint system that can be utilized in highway construction where gaps are formed between adjacent concrete sections. The expansion joints of the present invention find particular applicability in bridge constructions and other structures where large movements in multiple directions must be accommodated.

A gap is purposely provided between adjacent concrete structures for accommodating dimensional changes within the gap occurring as expansion and contraction due to temperature changes, shortening and creep caused by prestressing, seismic cycling and vibration, deflections caused by live loads and longitudinal forces caused by vehicular traffic. An expansion joint is conventionally utilized to accommodate these movements in the vicinity of the gap.

Bridge constructions are also subject to relative movement in response to occurrence of seismic events. This raises particular problems, because the movements occurring during such events are not predictable either with respect to the magnitude of the movements or with respect to the direction of the movements. In many instances bridges have become unusable for significant periods of time, due to the fact that traffic cannot travel across damaged expansion joints.

The difficulty in designing such expansion joints is that when a movement component of large magnitude is applied transverse to the roadway direction, the joints are typically unable to accommodate these movements. Attempts have been made to avoid this problem, as described, for example, in U.S. Pat. No. 4,674,912. This expansion joint system, which is sold by Maurer Sohne, GmbH, attempts to deal with the problem by using sliding and swiveling movements of the joint components to accommodate the non-longitudinal movements.

U.S. Pat. No. 4,120,066 to Leroux discloses an expansion joint for adjacent roadway sections to accommodate expansion or contraction of the distance between the adjacent concrete roadway sections, which utilizes a lazy tongs device.

U.S. Pat. No. 5,887,308 to Walter also discloses an expansion joint system for accommodating movement with an expansion joint.

The "Steelflex" system offered by D. S. Brown Company utilizes a center beam, which is individually attached to its own support bar. The support bars move parallel to the direction of movement of the structure.

The "Robek System" offered by Tech Star, Inc. includes modular joints designed to accommodate longitudinal movement. As with the other prior art systems, this design has not been proven effective to prevent significant damage under substantial seismic event conditions.

Therefore, a need still exists in the art for an improved expansion joint system that can accommodate large movements that occur separately or simultaneously in multiple directions in the vicinity of a gap having an expansion joint between two adjacent roadway sections, for example, in longitudinal and transverse directions relative to the flow of traffic, which may be caused by thermal changes, seismic events and vehicular deflections.

SUMMARY OF THE INVENTION

The present invention provides expansion joint system for roadway construction wherein a gap is defined between adjacent first and second roadway sections, said expansion joint system extending across said gap to permit vehicular traffic, said expansion joint system comprising: a plurality of transversely extending, spaced-apart, load bearing members having top surfaces and bottom surfaces, wherein said top surfaces are adapted to support vehicular traffic, at least one elongated support member having opposite ends extending longitudinally across said expansion joint from said first roadway section to said second roadway section, wherein said at least one support member is positioned below said transversely extending load bearing members, at least one first means for accepting an end of said at least one longitudinally extending elongated support member, wherein said at least one elongated support member has one end located within one of said first means for accepting, and wherein said first means for accepting includes means for substantially restricting transverse movement within said at least one first means for accepting, but permitting longitudinal movement within said first means for accepting, at least one second means for accepting an end of said at least one longitudinally extending elongated support member, wherein said second means for accepting include means for substantially restricting longitudinal movement within said second means for accepting, but permitting transverse and vertical movement within said second means for accepting, wherein said at least one elongated support member has one end located within said first means for accepting and the opposite end located in said second means for accepting; and at least one expansion and contraction means for controlling the spacing of said load bearing beams relative to one another comprising pivotably attached arms that are movably engaged with said load bearing members.

The present invention also provides an expansion joint system for roadway construction wherein a gap is defined between adjacent first and second roadway sections, said expansion joint system extending across said gap to permit vehicular traffic, said system comprising a plurality of transversely extending, spaced-apart, load bearing members having top surfaces and bottom surfaces, wherein said top surfaces are adapted to support said vehicular traffic, at least one elongated support member having opposite ends extending longitudinally across said expansion joint from said first roadway section to said second roadway section, wherein said at least one support member is positioned below said load bearing members, at least one first means for accepting one of said opposite ends of said at least one support member, wherein said at least one elongated support member has one end disposed within said first means for accepting, and wherein said first means for accepting include means for substantially restricting transverse movement within said first means for accepting, but permitting longitudinal movement within said first means for accepting, at least one second means for accepting an end of said at least one longitudinally extending elongated support members, wherein said second means for accepting include means for substantially restricting longitudinal movement within said second means for accepting, but permitting transverse and vertical movement within said second means for accepting, wherein said at least one elongated support member has one end located within said first means for accepting and the opposite end located in said second means for accepting, and at least one means positioned below said load bearing members and extending longitudinally across said expansion joint from said first roadway section to said second roadway section for controlling the distance between said load bearing members comprising: a) an elongated stabilizing member having opposite ends, one of said opposite ends having roller means attached thereto, wherein said end having rollers means attached thereto is disposed within a first means for accepting said stabilizing member that permits transverse movement and substantially restricts longitudinal movement of the stabilizing member within said first means for accepting, said opposite end being disposed within a second means for accepting said ends of said stabilizing member that permits longitudinal movement and substantially restricts transverse movement of the stabilizing member within said second means for accepting, b) at least one yoke assembly in movable engagement with said stabilizing member, and c) an expansion and contraction means positioned above said stabilizing member and above said least one yoke assembly, wherein said expansion and contraction means is attached to said at least one yoke assembly, and wherein said expansion and contraction means includes a plurality of pivotably attached arms, each arm including a plurality of roller means attached thereto and movably engaging at least two of said load bearing members.

The present invention further provides an expansion joint system for roadway construction wherein a gap is defined between adjacent first and second roadway sections, said expansion joint system extending across said gap to permit vehicular traffic, said system comprising: a plurality of transversely extending, spaced-apart, load bearing members having top surfaces and bottom surfaces, wherein said top surfaces are adapted to support said vehicular traffic, at least one support member having opposite ends extending longitudinally across said expansion joint from said first roadway section to said second roadway section, wherein said at least one support member is positioned below said load bearing members, and wherein one end of at least one said support member has a hole therein, at least one first means for accepting said support member, wherein said at least one elongated support member has one end located within said first means for accepting, and wherein said first means for accepting includes means for substantially restricting transverse movement within said first means for accepting, but permitting longitudinal movement within said first means for accepting, at least one second means for accepting said support, wherein said at least one elongated support member having said hole therein is located within said second means for accepting, wherein said second means for accepting includes means for substantially restricting longitudinal movement within said second means for accepting, but permitting transverse and vertical movement within said second means for accepting; said means for permitting transverse and vertical movement comprising a) a guide member disposed within said second means for accepting, said guide member being inserted through said hole in said support member, b) first support bearings disposed adjacent to upper and lower surfaces of said support members, c) second upper and lower support bearings disposed adjacent to said second means for accepting, and d) upper and lower retaining members secured to said second means for accepting said support members for securing said second support bearings; and at least one expansion and contraction means including pivotably attached arms movably engaged with said load bearing members.

The present invention further provides a device for use in an expansion joint system for roadway construction for providing longitudinal, transverse and vertical movement within said expansion joint and for controlling the spacing between transversely extending vehicular traffic load bearing beams comprising: an elongated stabilizing member having opposite ends, an expansion and contraction means for controlling the spacing between said transversely extending vehicular traffic load bearing beams, and at least one assembly for engaging said expansion and contraction means and said stabilizing member.

DETAILED DESCRIPTION OF THE PREFERRED EMBODIMENTS

This invention includes an expansion joint system which is installed in the gap between adjacent sections of a concrete structure, such as roadway. The expansion joint system has particular application in the construction of bridges and tunnels. The expansion joint system generally includes a plurality of vehicular traffic loading bearing members that are adapted to extend transversely within an expansion joint, a plurality of support members that extend longitudinally in the expansion joint across the gap and a mechanism for controlling the spacing between the transversely extending load bearing beam members. In certain embodiments, the means for controlling the spacing between the load bearing members maintains a substantially equal distance between the load bearing members in response to movement within the gap of the expansion joint. A plurality of compressible seal members can be engaged with the load bearing members extending transversely within the expansion joint relative to the direction of the flow of traffic. The expansion joint system of the present invention is particularly useful in the construction of bridges, tunnels, and the like that require accommodation of relatively large movements in multiple directions.

The invention is readily understood when read in conjunction with FIGS. 1–10, which are described in detail below.

Figure 1A:
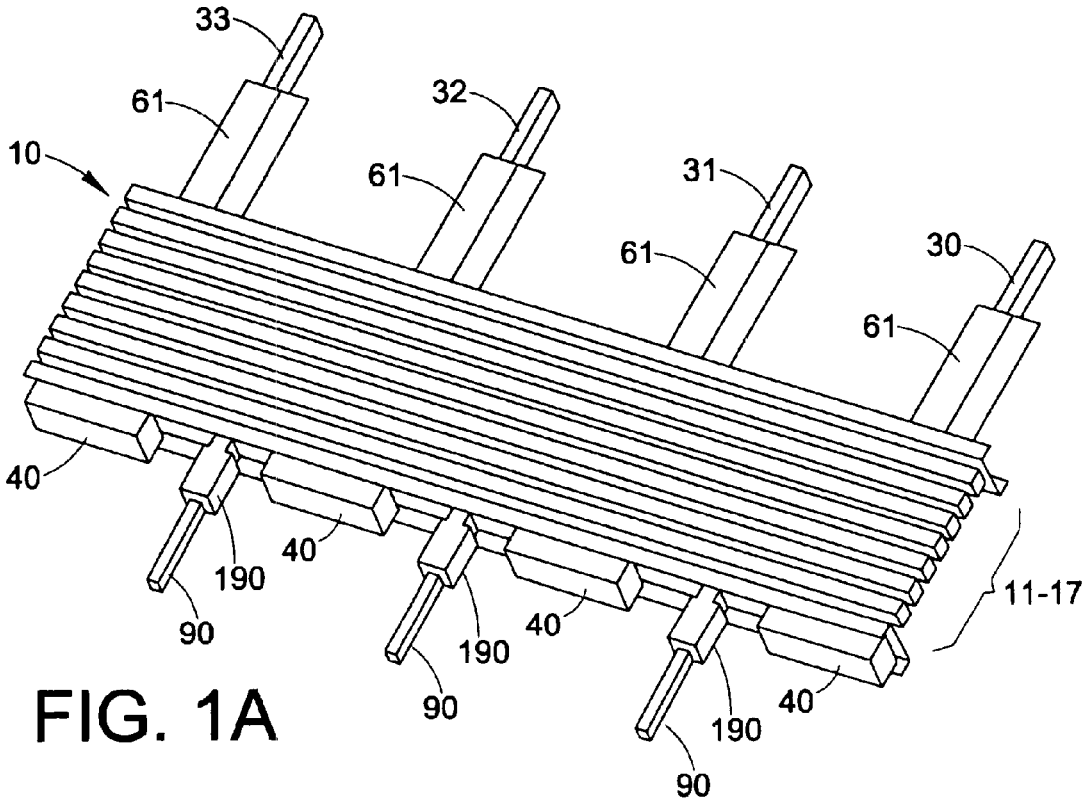
FIG. 1A is a top perspective view illustrating the expansion joint system of the invention.
Figure 1B:
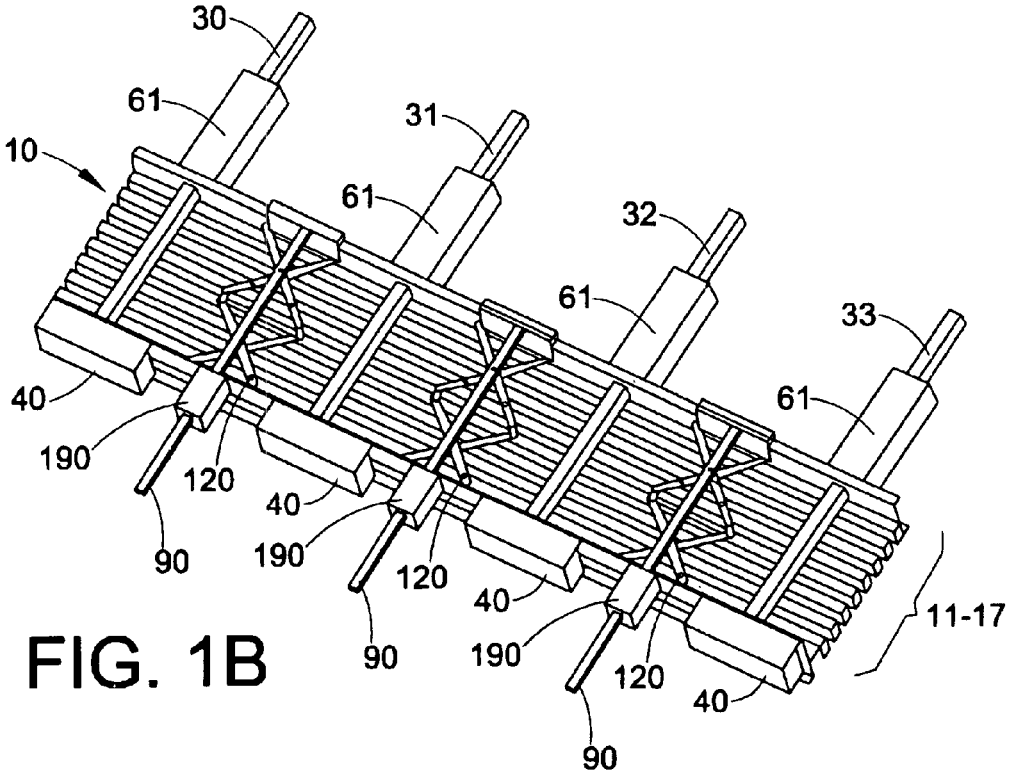
FIG. 1B is a bottom perspective view illustrating the expansion joint system of the invention.
Figure 1C:
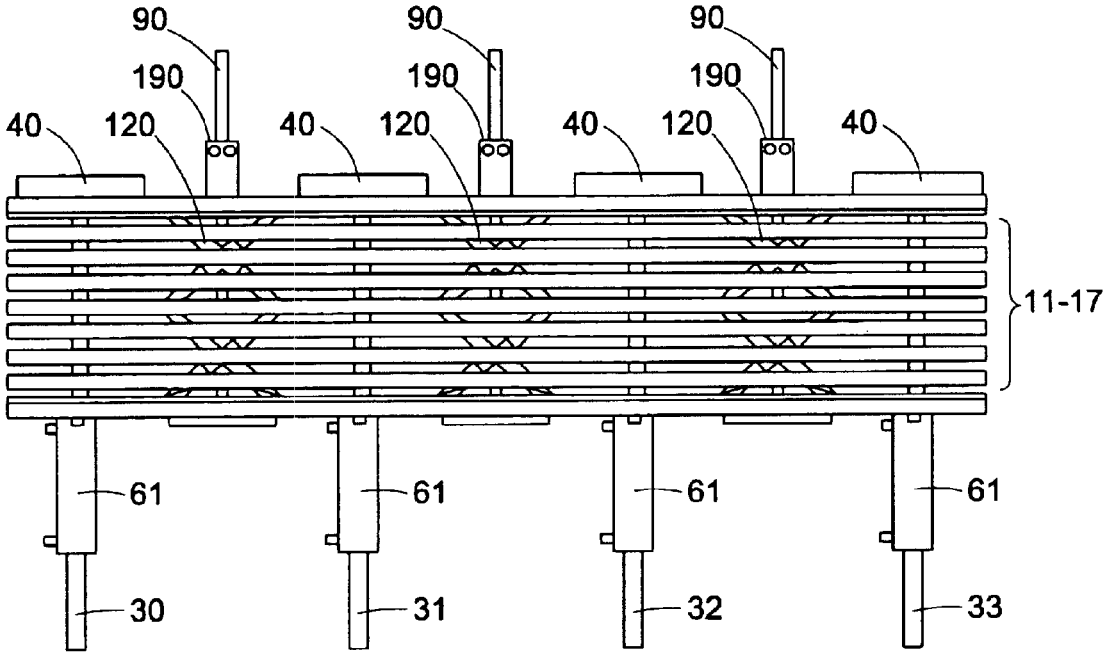
FIG. 1C is a top plan view illustrating the expansion joint system of the invention.

FIGS. 1A, 1B and 1C show the expansion joint system 10 of the present invention. Expansion joint system 10 includes a plurality of vehicular load bearing members 11–17. The vehicular load bearing beam members 11–17 of the system 10 are positioned in the gap between the adjacent roadway sections. According to certain embodiments, the load bearing beam members have a generally square or rectangular cross section. It should be noted, however, that the load bearing beam members 11–17 are not limited to beam members having approximately square or rectangular cross sections, but, rather, the load bearing beam members 11–17 may comprise any number of cross sectional configurations or shapes. The shape of the cross section of load bearing beams 11–17 is only limited in that the shape of the load bearing beams must be capable of providing relatively smooth and unimpeded vehicular traffic across the top surfaces of the beams, and the beams must have the ability to support engaging guides 25*a*–25*g* on the bottom surfaces of the beams. For example, the top surfaces 18*a*–24*a* of the load bearing beams may, for example, be contoured to facilitate the removal of debris and liquids, such as rainwater runoff.

The beam members 11–17 are positioned in a side-by-side relationship and extend transversely in the expansion joint relative to the direction of vehicle travel. The top surfaces 18*a*–24*a* of the load bearing beam members are adapted to support vehicle tires as a vehicle passes over the expansion joint. Compressible seals (not shown) can be placed and extend transversely between the positioned vehicular load bearing beam members 11–17 adjacent the top surfaces 18*a*–24*a* of the beam members 11–17 to fill the spaces between the beam members 11–17. The seals can also be placed and extend in the space between edge plates 133, 134 and end beam members 11, 17. The seals are flexible and compressible and, therefore, can stretch and contract in response to movement of the load bearing beams within the expansion joint. The seals are preferably made from a durable and abrasion resistant elastomeric material. The seal members are not limited to any particular type of seal. Suitable sealing members that can be used include, but are not limited to, strip seals, glandular seals, and membrane seals.

Referring to FIGS. 1B and 1C, the expansion joint system 10 includes support bar members 30–33. Support bars 30–33 are positioned in a spaced-apart, side-by-side relationship and extend longitudinally within the expansion joint, that is, the support bars 30–33 extend substantially parallel relative to the direction of vehicle travel across the expansion joint. The support bars 30–33 provide support to the vehicle load bearing beams 11–17 as vehicular traffic passes over the expansion joint. Support bar 30–33 also accommodate transverse, longitudinal and vertical movement of the expansion joint system within the gap. Each end of the support bars are received into a suitable means for accepting the ends of the support bars, and the several means for accepting the support bars are disposed, or embedded in the "block-out" portions of respective adjacent roadway sections in the roadway construction. The expansion joint system can be affixed within the block-out areas between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

In accordance with the invention, provision is made for particular types of movement of the support bars within the separate means for accepting the ends of the support members. In one embodiment, the means for accepting the ends of the support members comprises a box-like receptacle. It should be noted, however, that the means for accepting the ends of the support bar members may include any structure such as, for example, receptacles, chambers, housings, containers, enclosures, channels, tracks, slots, grooves or passages, that includes a suitable cavity for accepting the end portions of the support bar members.

Figure 3A:
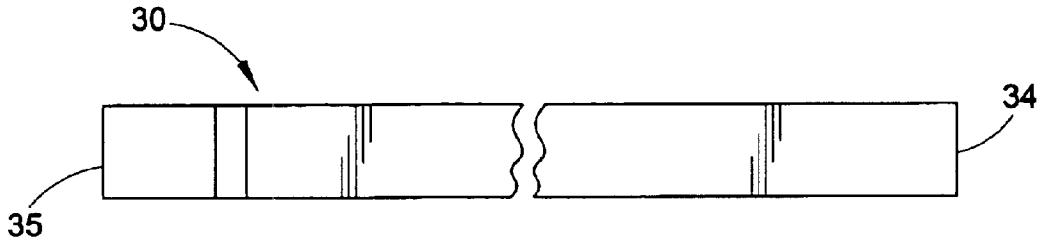
FIG. 3A is a top view of the support bar of the expansion joint system.
Figure 3B:
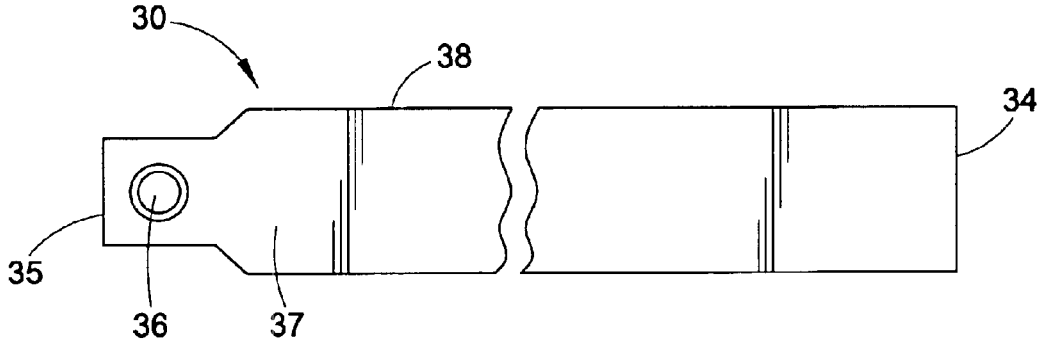
FIG. 3B is a side view of the support bar member of the expansion joint system.
Figure 3C:
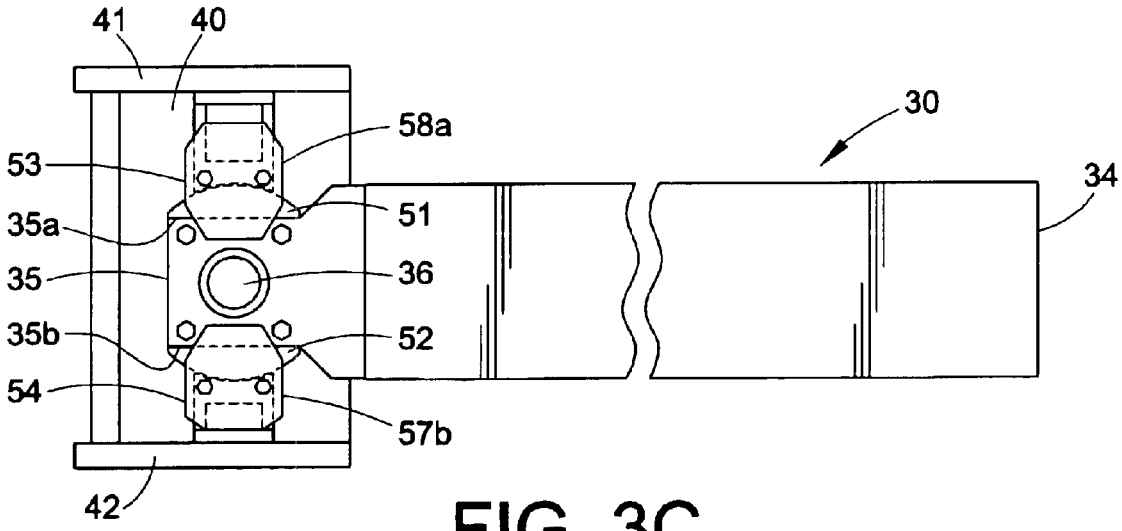
FIG. 3C is a side view of the support bar of the expansion joint system inserted into the transverse movement support box.

FIGS. 3A and 3B show an illustrative support member 30 of the expansion joint system 10. According to this embodiment, the support member 30 is shown as an elongated bar-like member having a square cross section. It should be noted, however, that the support member 30 is not limited to those elongated bar members having square cross sections, but, rather, the support member 30 may comprise an elongated bar member having a number of different cross sectional shapes such as, for example, round, oval, oblong and rectangular. The support bar 30 includes opposite ends 34, 35. End 35 of the support bar 30 is tapered to a lesser width relative to the remainder of the length of the bar 30, and includes a hole 36 communicating from one side 37 of the support bar 30 to the other side 38. The hole 36 is adapted to receive a securing means. End 35 of the support bar 30 having the hole 36 therein is adapted to be inserted into a means 40 for permitting transverse and vertical movement, but substantially restricting longitudinal movement of the support member 30 of the expansion joint system 10 within the means 40. FIG. 3C shows one end 35 of the support bar 30 inserted into means 40.

Figure 4:
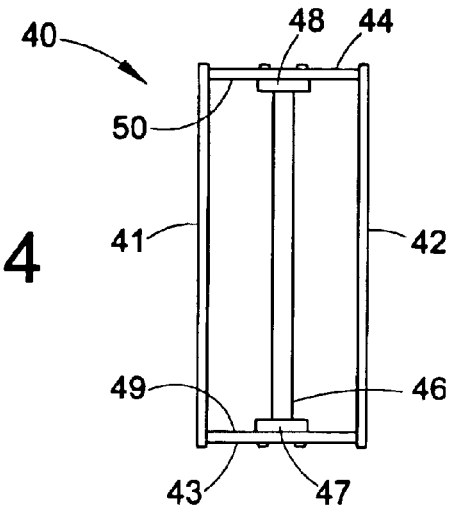
FIG. 4 shows a top view of one side of the transverse movement box assembly for receiving the support bar member of the expansion joint system.

FIG. 4 shows means 40, which according to the embodiment shown is a substantially rectangular box structure, and which permits transverse and vertical movement of support bars 30–33 of the expansion joint system 10 in response to movement within the expansion joint. The transverse and vertical movement box 40 includes top 41 and bottom 42 plates, side plates 43, 44 and back plate (shown removed). According to this embodiment, the securing means 46 is an elongated, substantially cylindrical guide rod to which a support bar 30–33 is engaged. The securing means 46 is substantially centrally disposed within box 40 and extends across box 40 from side plate 43 to side plate 44. The securing means 46 is held in place by holding plates 47, 48, which are attached to the inside wall surfaces 49, 50 of side plate 43 and side plate 44, respectively. The securing means 46 is inserted into the hole 36 in order to secure the support bars 30–33 within means 40. The securement means 46 can be any means which permits pivotable movement of end 35 of the support bar in the vertical direction within means 40, while further permitting transverse movement of end 35 of the support bar along the axis of the securement means. Thus, the securing means 46 substantially restricts longitudinal movement of the support bars 30–33, but permits transverse and vertical movement. While the securing means 46 is shown in FIG. 4 as a cylindrical guide rod, it may, for example, include differently shaped rods, bars, pegs, pins, and bolts.

Figure 5A:
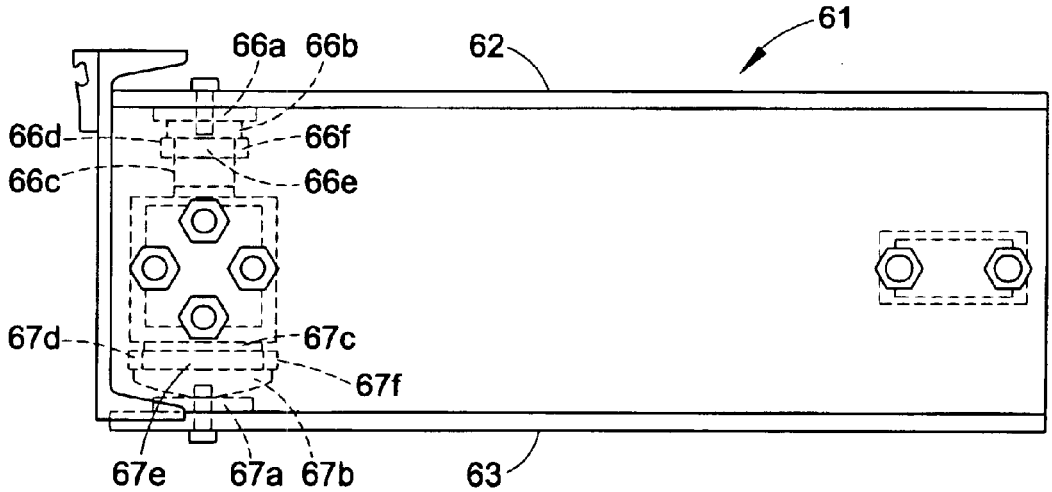
FIG. 5A is a side view of the longitudinal movement support box for the support bar means of the expansion joint system.

FIG. 5A shows the longitudinal movement support bar box 61. In certain embodiments, the longitudinal movement support bar box comprises a box-like receptacle. It should be noted, however, that the longitudinal movement support bar box may include any structure such as, for example, receptacles, chambers, housings, containers, enclosures, channels, tracks, slots, grooves or passages, that includes a suitable cavity for accepting the end portions 34 of the support bar members 30–33 that are opposite the ends 35 that are inserted into the transverse movement box 40. Box 61 includes top plate 62, bottom plate 63 and side plates (not shown). Longitudinal movement support bar box 61 is adapted to receive the end 34 of the support bar 30, which is opposite to the end 35 of the support bar 30, which is inserted into transverse movement box 40. A portion of support bar 30 is received into box 61, and the position of the top and bottom sides of the support bar 30 are maintained within box 61 by upper and lower plates 66*a*, 67*a*, upper 66*b* and lower 67*b* curved rocker bearings and keeper members 66*d*–66*f*, 67*d*–67*f*, respectively, disposed thereon, and upper 66*c* and lower 67*c* bearings that are held in place by the rocker bearing keeper members.

Box 61 includes means for permitting longitudinal and vertical movement of the support bars 30–33 within box 61, and means for substantially preventing transverse movement of support bars 30–33 within the box 61. Preferably, the upper 66*a*, 66*b* and lower means 67*a*, 67*b* maintain the vertical load on the support bars perpendicular to the axis of the support bars and, permits slidable movement of the support bars in the direction of vehicular traffic flow (longitudinal movement). Side bearing means 68, 69 substantially prevent transverse movement of support bars 30–33 within box 61, while not inhibiting or otherwise preventing longitudinal and vertical movement. According to the embodiment shown, side means 68, 69 are provided in the form of bearing plates that are disposed adjacent the inner surfaces of box 61.

The use of the upper 66*a* and lower 66*b* bearing plates and upper 66*b* and lower 67*b* rocker bearings maintains the vertical load on the bearings perpendicular to the sliding surfaces. The upper 66*b* and lower 67*b* rocker bearings are capable of absorbing impact from vehicular traffic moving across the expansion joint system. However, it should be appreciated that spring-loaded means, liquid or air charged pistons, or elastomeric cushioning devices could be used in place of the upper and lower bearings.

Figure 5B:
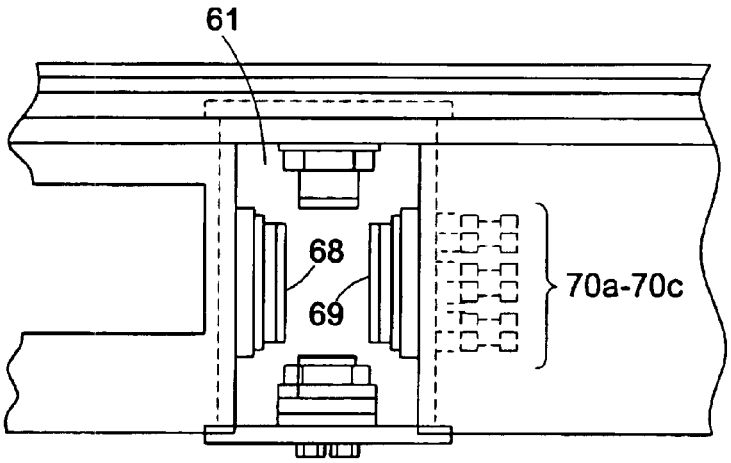
FIG. 5B is an end view of the longitudinal movement support box for the support bar means of the expansion joint system.

Now referring to FIG. 5B, the position of the sides of the support bar 30 are further maintained within the longitudinal movement support bar box 61 by bearing plates 68, 69, which are attached to the inner surfaces of box 61 facing toward the support bar 30 via bearing bolts 70*a*–70*c*.

The transverse movement box for receiving one end of the support bars are designed to permit transverse and vertical movement of the support bars within the boxes in response to changes in temperature changes, seismic movement or deflections caused by vehicular traffic, while restricting longitudinal movement. Longitudinal boxes for receiving the opposite ends of the support bars are designed to permit relative longitudinal movement of the support bar within the boxes, while confining the bars against relative transverse movement.

FIGS. 3A–3C show a more detailed view of the tapered and holed end 35 of support bar 30, which has been inserted into box 40 and which is in contact with support bar bearings and holding plates. It should be appreciated that end 35 of support bar 30 is engaged within box 40 in such a manner to permit transverse and vertical movement of support bar 30. Concave support bar bearings 51, 52 are engaged with the tapered end 35 of the support bar 30. Again, it should be appreciated that spring-loaded, liquid or air charged, or elastomeric cushioning devices could be used in place of the concave support bar bearings 51, 52.

Top support bar bearing 51 is placed in contact with the top surface 35*a* of the tapered end 35 of the support bar 30. Bottom support bar bearing 52 is placed in contact with the bottom surface 35*b* of the tapered end 35 of support bar 30. Additional top support bar bearing 53 is placed between top support bar bearing 51 and the top plate 41 of transverse box 40. Additional bottom support bearing 54 is located between the bottom support bar bearing 52 and the bottom plate 42 of transverse box 40. Support bar 30 and support bar bearings 51–54 are held in place by lower holding plate 57*a*, 57*b* and upper holding plate 58*a*, 58*b*, which are positioned on each side 37, 38 of support bar 30. The upper and lower holding plates that are disposed adjacent to side 38 of support bar 30 are not shown in FIG. 3C. As discussed hereinabove, the securing means 46 is passed through hole 36 of support bar 30. The use of the securing means 46 through hole 36 in support bar 30 in combination with the curved upper and lower support bar bearings permits the support bar 30 to move transversely (relative to the direction of traffic) and further allows the support bar 30 to pivot in the vertical direction.

Figure 6A:
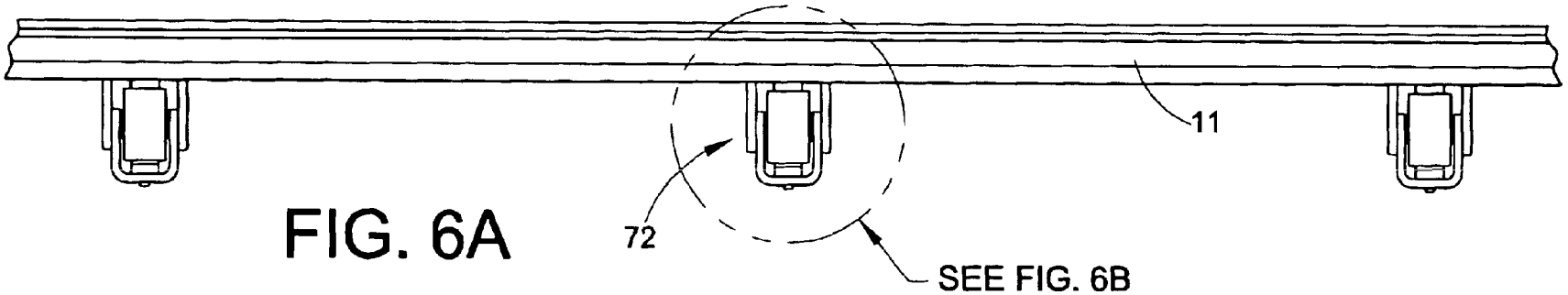
FIG. 6A is a side view of a portion of the expansion joint system including an end view of the yoke assembly for maintaining the support bar member in proximity to the bottom surfaces of the load bearing beams of the expansion joint system.
Figure 6B:
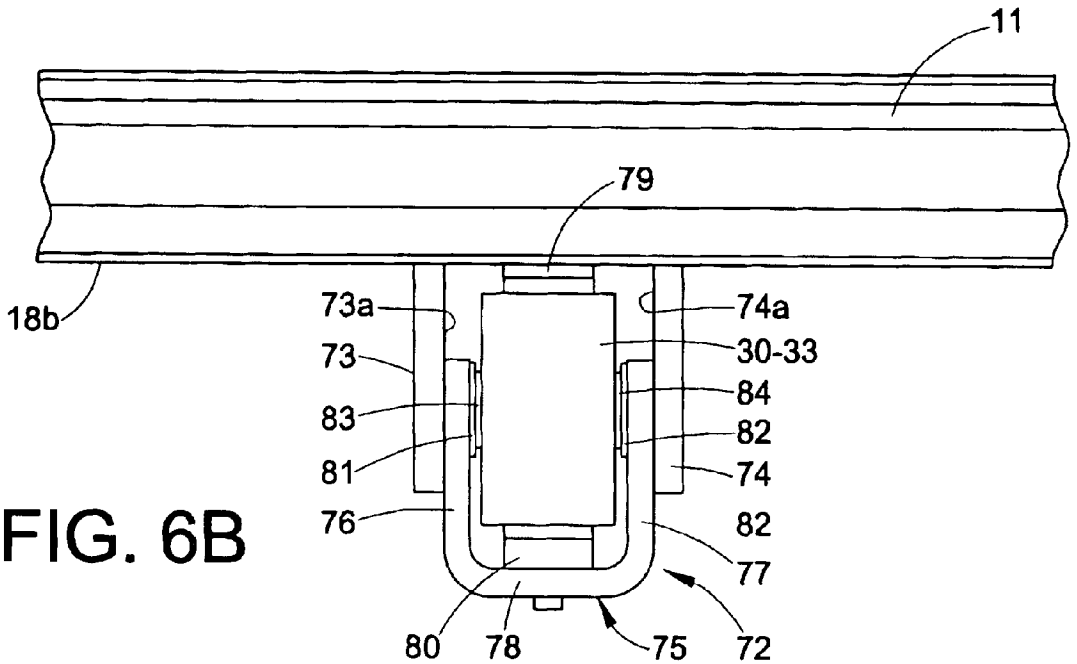
FIG. 6B is an enlarged fragmentary side view of a portion of the expansion joint system including an end view of the yoke assembly for maintaining the support bar member in proximity to the bottom surfaces of the load bearing beams of the expansion joint system.

Means are provided to maintain the position of support bars 30–33 relative to the bottom surfaces of the load bearing beams members 11–17. Also, the means provides a mechanism which permits longitudinal and limited vertical movement of the support bars 30–33 within the means. FIGS. 6A and 6B show one embodiment of the means, which comprises a yoke or stirrup assembly 72 for retaining the position of the support bars 30–33 relative to the bottom surfaces of the load bearing beams 11–17 of the expansion joint system 10. As shown in FIG. 6B, the yoke assembly 72 includes spaced-apart yoke side plates 73, 74 that are attached to and extend away from the bottom surface 18*b* of the vehicular load bearing beam 11. Bent yoke plate 75 includes leg portions 76, 77 and spanning portion 78 that extends between legs 76, 77. The yoke assembly 72 also includes upper yoke bearing 79 and lower yoke bearing 80. The yoke assembly 72 utilizes flexible upper 79 and lower 80 yoke bearings to minimize yoke tilt and optimizes the ability of the expansion joint system 10 to absorb vehicular impact from traffic moving across the expansion joint system 10. Spring-loaded, liquid or air charged, or elastomeric cushioning devices could be used in place of the upper 79 and lower 80 yoke bearings. While the one embodiment is shown utilizing a yoke or stirrup assembly to maintain the positioning of the support bars 30–33, any restraining device or "hold-down" device or the like that can maintain the position of the support bars 30–33 relative to the load bearing beams 11–17 may be utilized.

Yoke assembly 72 further includes yoke retaining rings 81, 82 and yoke discs 83, 84, which are located on the inner surfaces of bent yoke legs 76, 77. The yoke retaining rings 81, 82 and yoke discs 83, 84 are provided to allow limited vertical and longitudinal movement of the support bars 30–33. The yoke assembly 72 could also be provided with pivotal bushing-type devices in place of the of the upper 79 and lower 80 yoke bearings, yoke retaining rings 81, 82, and yoke discs 83, 84. Furthermore, the yoke side plates 73, 74 are spaced apart at a distance sufficient to permit bent yoke plate 75 to be inserted in the space defined by the inner surfaces 73*a*, 74*a* of yoke side plates 73, 74.

The expansion joint system 10 also includes a mechanism for controlling the spacing between the transversely disposed load bearing beam members 11–17 in response to movement in the vicinity of the expansion joint. In one embodiment, the mechanism for controlling the spacing between beam members 11–17 maintains a substantially equal distance between the spaced-apart, traffic load bearing beams 11–17 that are transversely positioned within the gap in an expansion joint, in response to movements caused by thermal or seismic cycling and vehicle deflections.

Figure 7A:
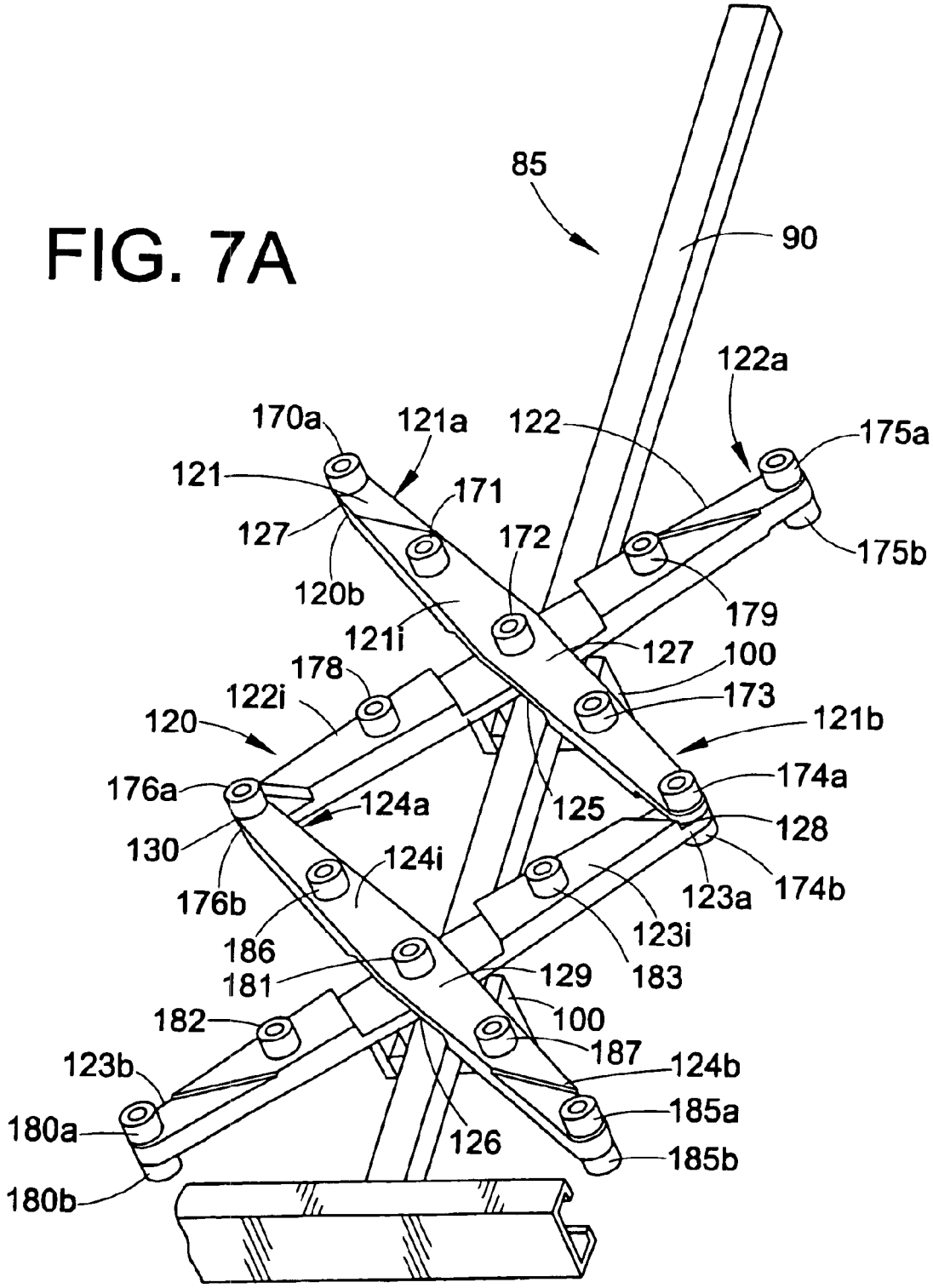
FIG. 7A is a top perspective view of one embodiment of the expansion joint system showing the means for controlling the spacing between the load bearing beams, stabilizing bar member and yoke assembly.
Figure 7B:
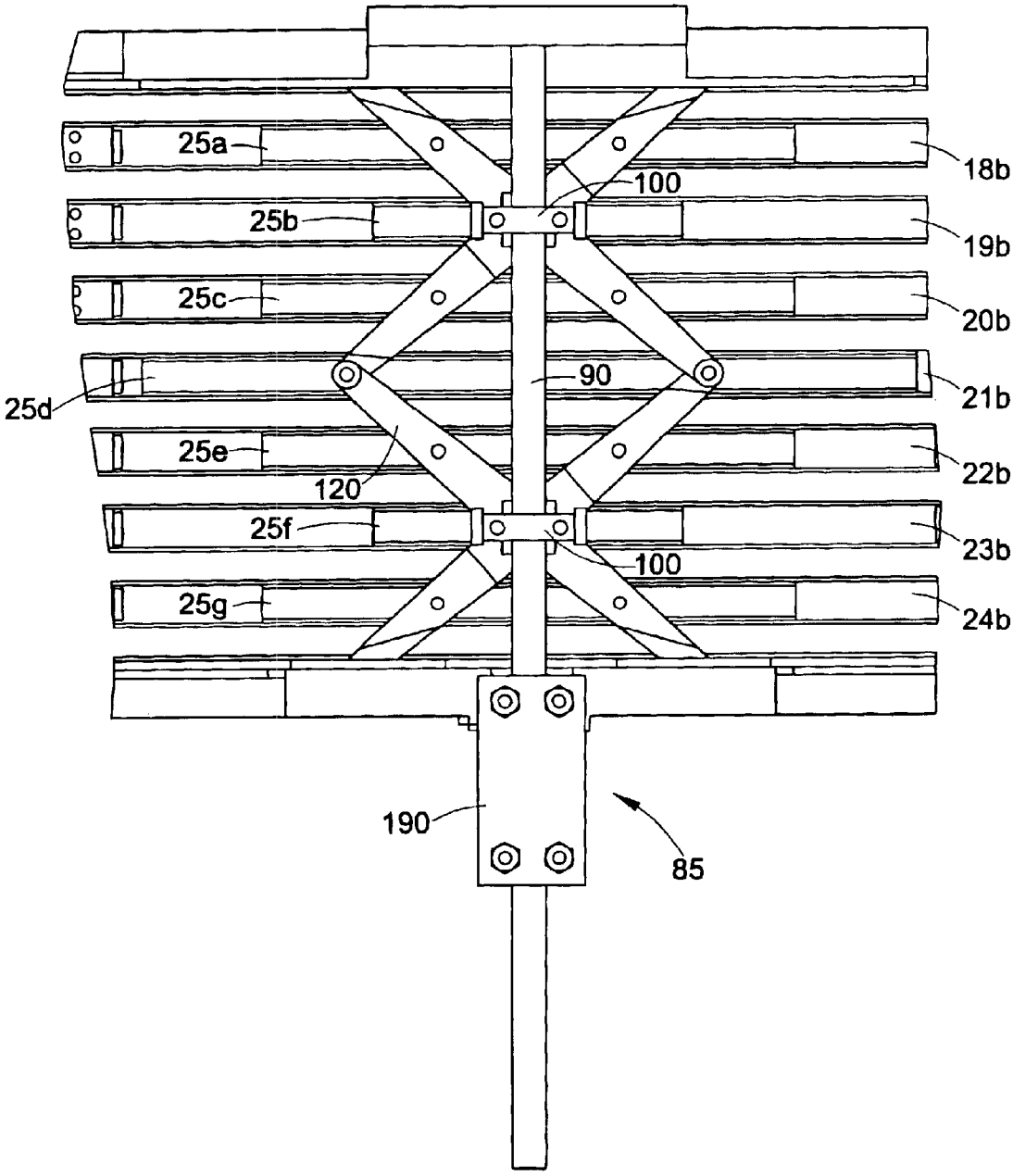
FIG. 7B is a bottom plan view of the means for controlling the spacing between the load bearing members engaging the bottom surfaces of the vehicular load bearing beams.

FIG. 7A shows a perspective view of one embodiment of the means for controlling the spacing between the load bearing beams, which is mechanism 85. FIG. 7B shows a bottom plan view of the mechanism 85 engaged with the bottom surfaces 18*b*–24*b* of vehicular load bearing beams 11–17. Generally, mechanism 85 provides for relative movement of the transversely disposed load bearing beam members 11–17 in the direction of vehicular traffic flow. That is, mechanism 85 provides for relative movement of the load bearing beams 11–17 in the longitudinal direction relative one another. Mechanism 85 includes means for controlling the spacing between the beam members by providing the relative longitudinal movement of the load bearing beam members, optionally, means for supporting the means controlling the spacing of the load bearing beams and, optionally, means for engaging the means controlling the spacing of the bearing beams and the supporting means. In one embodiment, the mechanism 85 generally includes a stabilizing bar member 90, at least one yoke assembly 100 and an expansion and contraction means 120.

Figure 7C:
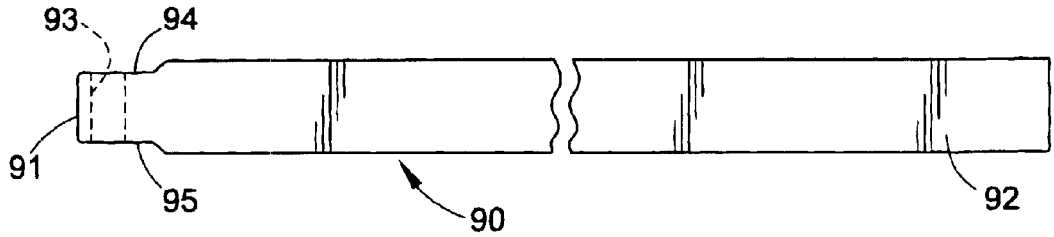
FIG. 7C is a side view of one end of the stabilizing bar member of the expansion joint system.
Figure 7D:
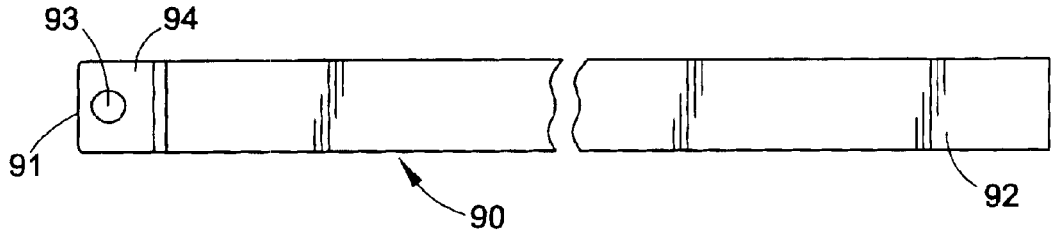
FIG. 7D is a top view of one end of the stabilizing bar member of the mechanism of the expansion joint system.
Figure 7E:
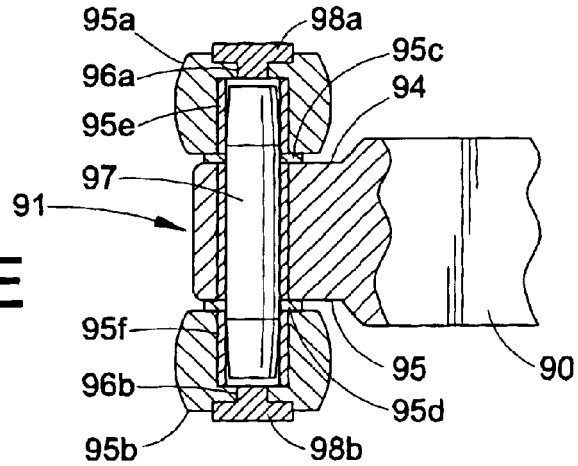
FIG. 7E is a side view of an end of the stabilizing bar member of the expansion joint system having roller means attached thereto.

With respect to FIGS. 7C and 7D, the stabilizing bar 90, in one embodiment, is a substantially elongated, preferably square-shaped (in cross-section) bar member having opposite first and second ends 91, 92. Stabilizing bar 90 is not limited to having an approximately square-shape section, but, rather, the stabilizing bar 90 may have a number of cross sectional shapes. One end 91 of the elongated stabilizing bar 90 is tapered to a width that is less than the width of the remainder of the stabilizing bar 90. The tapered end 91 of stabilizing bar 90 is further provided with a hole 93 communicating from the top side 94 to the bottom side 95 of the tapered end 91 of the stabilizing bar 90. Now turning to FIG. 7E, rollers 95*a*, 95*b* are attached to the tapered end 91 of the stabilizing bar 90. The rollers 95*a*, 95*b* are substantially round and have a substantially centrally disposed hole 96*a*, 96*b* that communicates from a first surface to a second surface of the roller 95*a*, 95*b*. The hole 93 of the stabilizing bar 90 is adapted to receive a pin means 97, which anchors rollers 95*a*, 95*b* to the tapered end 91 of the bar 90. Specifically, the rollers 95*a*, 95*b* are attached to the tapered end 91 of the stabilizing bar by inserting the pin 97 through the hole 93 located near the end 91 of the stabilizing bar 90 and through a portion of the holes of the rollers 95*a*, 95*b*. The rollers are then secured to the stabilizing bar 90 by securement means 98*a*, 98*b* that are inserted into the holes 96*a*, 96*b* of the rollers 95*a*, 95*b*. The securement means 98*a*, 98*b* could, for example, comprise a bolt, cap, peg, pin, plug, screw or the like that anchors the rollers 95*a*, 95*b* to the bar 90, but, at the same time, allows free rotation of the rollers 95*a*, 95*b*. Furthermore, washers 95*c*, 95*d* may be fitted over the ends 97*a*, 97*b* of pin 97 and tubular roller bearings 95*e*, 95*f* may be fitted over the portions of pin 97 that are inserted into rollers 95*a*, 95*b*.

Figure 8:
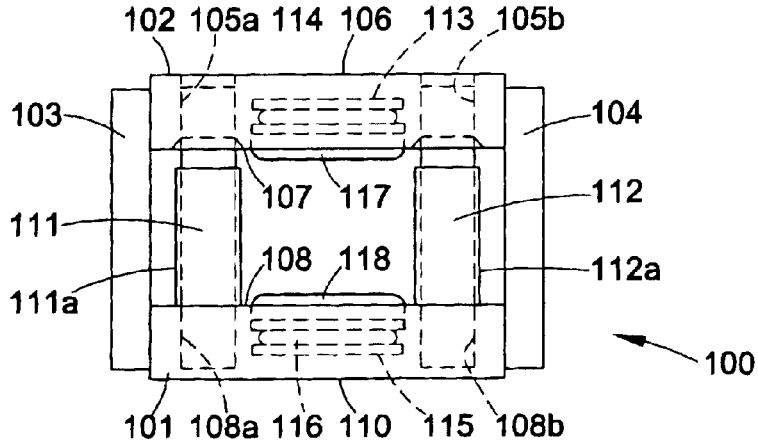
FIG. 8 is side view of one embodiment of the yoke assembly for movably engaging the expansion and contraction means and the stabilizing bar.

The elongated stabilizing bar 90 of the mechanism 85 is movably engaged by at least one yoke assembly 100. According to this construction, the stabilizing bar member 90 is not fixedly attached to either the yoke assembly 100 or to the expansion and contraction means 120 of mechanism 85. FIG. 8 shows a side view of one embodiment of the yoke assembly 100 which engages the stabilizing bar. According to this one embodiment, the stabilizing bar 90 passes through the yoke assembly 100. The yoke assembly 100 may include lower yoke plate 101, upper yoke plate 102 and side yoke plates 103, 104. Upper yoke plate 102 includes spaced-apart holes 105*a*, 105*b*, which communicate from the upper surface 106 of the upper yoke plate 102 through to the lower surface 107 of the upper yoke plate 102. Lower yoke plate 101 includes spaced-apart holes 108*a*, 108*b*, which communicate from the upper surface 109 of lower yoke plate 101 through to the lower surface 110 of the lower yoke plate 101. The holes 105*a*, 105*b*, 108*a* and 108*b*, are adapted to receive substantially cylindrically-shaped rollers 111, 112. Roller bearings 111*a*, 112*a* are fitted as a sheath around rollers 111, 112, respectively.

Upper yoke plate 102 also includes recessed roller groove 113, that is disposed between holes 105*a*, 105*b*. Upper roller bed 114 is inserted into upper recessed roller groove 113 of the upper yoke plate 102. Lower yoke plate 101 is provided with a recessed roller groove 115 between holes 108*a*, 108*b*. Lower roller bed 116 is inserted into lower recessed roller groove 115 of lower yoke plate 101. Roller 117 is horizontally disposed in recessed roller groove 113 and roller 118 is horizontally disposed in recessed roller groove 115. In operation, stabilizing bar 90 can move within the yoke assembly 100 in the space defined between vertical rollers 111, 112 and top and bottom rollers 117, 118. Vertical rollers 111, 112 are sufficiently spaced apart from the inner wall surfaces of yoke side plates 103, 104 to permit free rotation of the rollers 111, 112 and controlled movement of the stabilizing bar 90 within the yoke assembly 100. The use of at least one yoke assembly 100 maintains the position of the stabilizing bar 90 during movement within the gap in the expansion joint. During movement in the gap in the expansion joint, the stabilizing bar 90 can move vertically against side rollers 111, 112 in a rolling fashion. During movement in the gap in the expansion joint, the stabilizing bar 90 can slide against upper 117 and lower 118 rollers. The use of vertical side rollers 111, 112 and upper and lower rollers 117, 118 permits the yoke assembly 100 to be attached to one of the vehicular load bearing beams 11–17, while maintaining controlled movement of the stabilizing bar 90 without having to fixedly attached the stabilizing bar 90 to the load bearing members 11–17 or to the yoke assembly 100.

While the yoke assembly has been described with respect to the one embodiment shown in FIG. 8, it should be noted that the yoke assembly can comprise other configurations that are capable of engaging the elongated stabilizing bar 90. Another non-limiting configuration of the yoke assembly includes, for example, a saddle-like assembly that can engage the stabilizing bar 90.

Figure 10A:
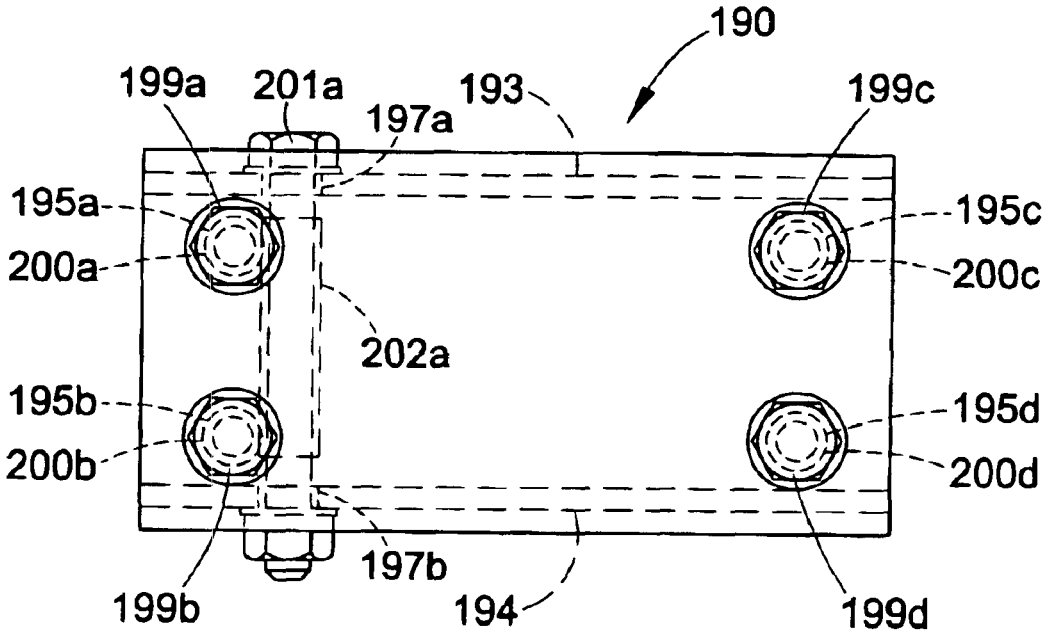
FIG. 10A is a top view of one embodiment of the longitudinal movement box which receives one end of the stabilizing bar member.
Figure 10B:
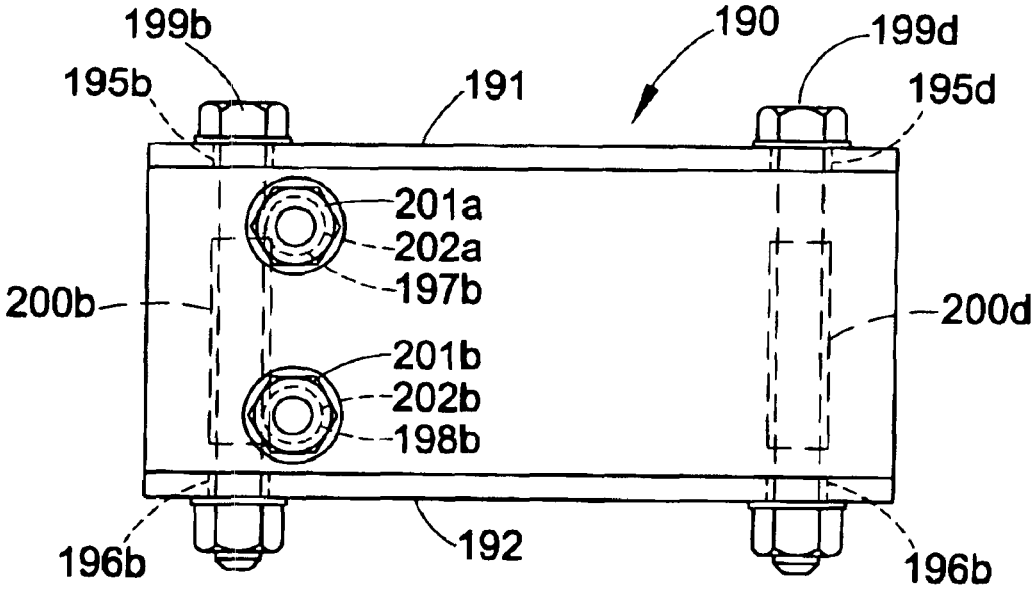
FIG. 10B is a side view of one embodiment of the longitudinal movement box which receives one end of the stabilizing bar member.

Second end 92 of stabilizing bar 90 is adapted for insertion into means 190 for accepting the stabilizing bar member 90. According to the embodiment shown, the means 190 for accepting the stabilizing bar 90 is a box-like chamber. The means 190 for accepting the stabilizing bar 90 may also include any structure such as, for example, receptacles, chambers, housings, containers, enclosures, channels, tracks, slots, grooves or passages, that includes a suitable cavity for accepting the second end 92 of the stabilizing bar 90. Referring to FIGS. 10A and 10B, box 190 includes upper 191 and lower 192 plates and side plates 193, 194. In one embodiment, the upper 191 and lower 192 plates include holes aligned holes to accept a bolt or pins means. As shown in FIG. 10A, upper plate 191 includes holes 195*a*–195*d* that are adapted to receive an elongated fastening means such as, for example, a bolt or pin means. According to the embodiment shown in FIG. 10A, bolt means 199*a*–199*d* pass through holes 195*a*–195*d*, respectively, of upper plate 191. Now turning to FIG. 10B, bolt means 199*b* is inserted through hole 195*b* and passes through box 190 and exits box 190 through hole 196*b*. Bolt means 199*d* is inserted through hole 195*d*, passes through box 190 and exits box 190 through hole 196*d*. While not shown in FIG. 10B, bolt means 199*a* is inserted through hole 195*a* (as shown in FIG. 10A), passes through box 190 and exits box 190 through hole 196*a* (not shown) and bolt means 199*c* is inserted through hole 195*c* (as shown in FIG. 10A), and passes through box 190 and exits box 190 through hole 196*c* (not shown). As shown in FIG. 10B, means 199*b* and 199*d* are fitted with roller bearings 200*b* and 200*d*, respectively. Side plates 193, 194 may include holes 197*a*, 197*b* and 198*a*, 198*b* respectively. Holes 197*a*, 197*b*, 198*a* and 198*b* are also adapted to receive bolt or pin means. Means 201*a*, 201*b* are inserted through holes 197*a*, 198*a* (not shown), respectively. Means 201*a*, 201*b* pass through box 190 and exit box 190 through holes 197*b*, 198*b*, respectively. Means 201*a*, 201*b* are fitted with roller bearings 202*a*, 202*b*. The use of the bolt or pin means fitted with the roller bearings maintains low friction forces during movement within the gap in the expansion joint, and allows the stabilizing bar 90 to pivot in the vertical directions while still guiding the stabilizing bar 90 laterally.

The mechanism 85 includes an expansion and contraction means 120 that includes a plurality of arms that are pivotably attached to one another to allow free expansion and contraction of the mechanism 85 in a longitudinal direction relative to the flow of vehicular traffic across the expansion joint. Referring again to FIG. 7A, a certain embodiment of the expansion and contraction means 120 of the mechanism 85 is shown. According to this one embodiment, the expansion and contraction means 120 is an expandable and contractable accordion-type mechanism. However, the expansion and contraction means 120 could also be configured with spring-like or piston-like shock absorbers to facilitate expansion and contraction. According to the embodiment shown in FIG. 7A, the expansion and contraction means 120 includes four arms 121–124 that are pivotably attached in a manner to permit expansion and contraction of the mechanism 85 in the expansion joint. It should be noted that the expansion and contraction means can include fewer or more arms, depending on the desired application. Furthermore, the mechanism 85 may comprise only the expansion and contraction means 120, and can provided without the stabilizing bar 90 or yoke assembly 100. In another embodiment, at least one pivot point of the expansion and contraction means 120 can be mechanically attached to one of the load bearing beams by bolting or pinning.

Figure 9A:
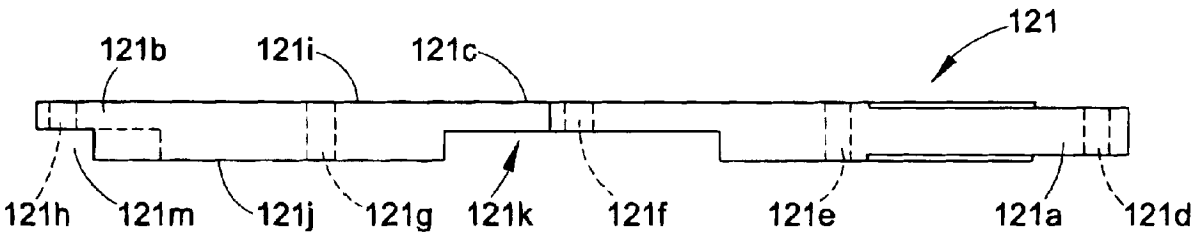
FIGS. 9A–9D shows dissembled side views of the arms of the expansion and contraction means.
Figure 9B:
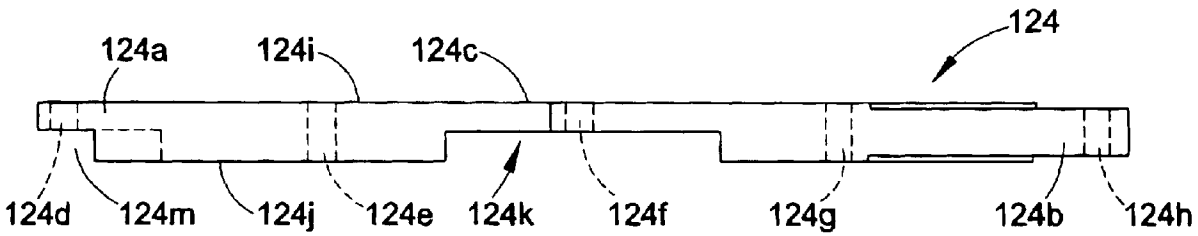
Figure 9C:
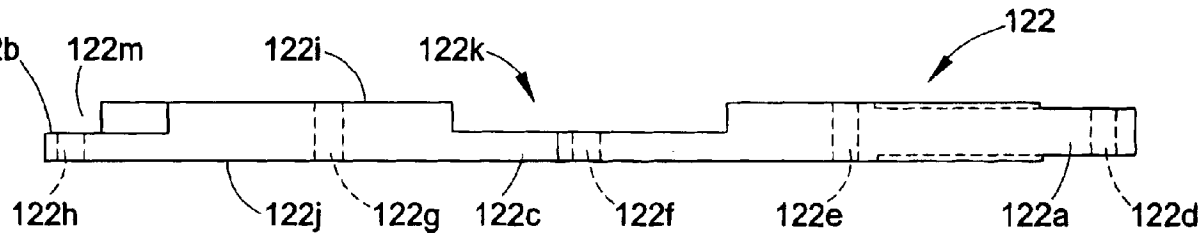
Figure 9D:
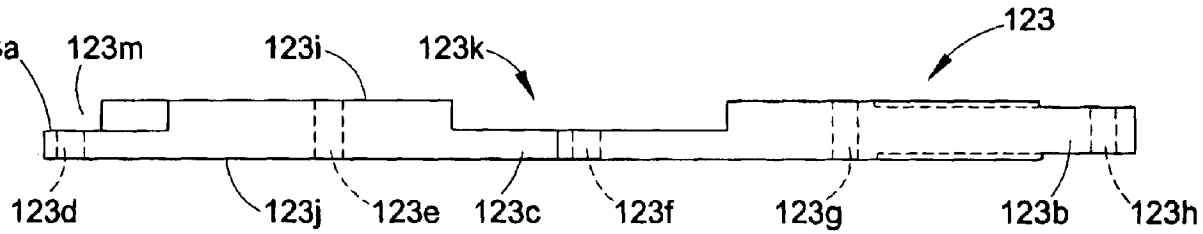

FIGS. 9A–9D show the dissembled arms 121–124 of one embodiment of the expansion and contraction means 120 of the mechanism. The arms 121–124 of the expansion and contraction means 120 are elongated. The elongated arms can comprise a number of non-limiting cross sectional shapes that will permit pivoting of the arms at the pivot point to effect that expansion and contraction function of the device. For example, the arms 121–124 may include planar, cylindrical or square cross sections. Preferably, the arms 121–124 of the expansion and contraction means 120 are substantially planar. The term substantially planar is used to indicate that the arms 121–124 of the expansion and contraction means are substantially flat. It should be noted, however, that the term planar is intended to include arms having notches, grooves or recesses on one or both opposing surfaces. As shown in FIG. 9A, arm 121 has opposite first 121*a* and second 121*b* ends and a center region 121*c*. As shown in FIG. 9C, arm 122 has opposite first 122*a* and second 122*b* ends and a center region 122*c*. According to FIG. 9D, arm 123 has opposite first 123*a* and second 123*b* ends and a center region 123*c*. According to FIG. 9B, arm 124 has opposite first 124*a* and second 124*b* ends and a center region 124*c*. Arms 121–124 of the expansion and contraction means 120 may be tapered toward their ends and may terminate into rounded ends, although this is merely one embodiment. Arms 121–124 may be provided with a number of spaced-apart, substantially equidistant holes 121*d*–121*h*, 122*d*–122*h*, 123*d*–123*h* and 124*d*–124*h*, respectively, which communicate from surfaces 121*i*, 122*i*, 123*i*, 124*i* through to the opposite surfaces 121*j*, 122*j*, 123*j*, and 124*j* of arms 121–124. In a preferred embodiment, the arms are provided with holes that are located near the center region of the arms and substantially near the opposite ends of the arms. According to this embodiment, each of the arms is also provided with holes located in the regions between the end holes and the center holes of each of the arms. It should be noted that the number of arms comprising the expansion and contraction means 120 can vary, depending on the application. For example, in one embodiment, the expansion and contraction means 120 may comprise two pivotably attached arms. The number and position of the holes in arms can be easily determined by one having ordinary skill in the art, depending on the specific application of the system 10. The holes that are provided on the arms 121–124 are adapted to receive fastener means to secure roller means to the arms. Alternatively, the holes may be adapted to receive a bolt or pin means for sliding engagement with the load bearing beams.

As shown in FIG. 7B, each of arms 121–124 are provided with at least one roller means for slidably engaging each of the arms 121–124 to the load bearing members via the guides 25*a*–25*g*. In the embodiment shown in FIG. 7A, arm 121 includes rollers 170*a*, 170*b* (170*b* not shown) located near first end 121*a* of arm 121, rollers 174*a*, 174*b* located near second end 121*b* of arm 121, roller 172 located in the center region 121*c* of arm 121, roller 171 located in the space between first end 121*a* and center region 121*c* of arm 121, and roller 173 is located in the space between second end 121*b* and center region 121*c* of arm 121. Arm 122 includes rollers 175*a*, 175*b* located near first end 122*a* of arm 122, rollers 176*a*, 176*b* (176*b* not shown) located near second end 122*b* of arm 122, roller 179 located in the space between first end 122*a* and center region 122*c* of arm 122, and roller 178 located in the space between second end 122*b* and center region 122*c* of arm 122. Arm 123 includes rollers 174*a*, 174*b* located near first end 123*a* of arm 123, rollers 180*a*, 180*b* located near second end 123*b* of arm 123, roller 181 located in the center region 123*c* of arm 123, roller 183 located in the space between first end 123*a* and center region 123*c* of arm 123, and roller 182 is located in the space between second end 123*b* and center region 123*c* of arm 123. Arm 124 includes rollers 176*a*, 176*b* located near first end 124*a* of arm 124, rollers 185*a*, 185*b* located near second end 124*b* of arm 124, roller 186 located in the space between first end 124*a* and center region 124*c* of arm 124, and roller 187 located in the space between second end 124*b* and center region 124*c* of arm 124. The arms pivot at pivot points 127–130, while rollers 171–174, 176–179 and 181–183 slide within guides 25*a*–25*g* and rollers 170*a*, 170*b*, 175*a*, 175*b*, 180*a*, 180*b*, 185*a* and 185*b* slide within guides 130, 132 to expand or contract within the space in the gap of the expansion joint, to control the distance between the load bearing beams 11–17. In one embodiment, the expansion and contraction means 120 maintains a substantially equal distance between the load bearing members.

Referring to FIG. 9A, a first arm 121 of the expandable and contraction means 120 includes opposite facing first 121*i* and second 121*j* surfaces, and first 121*a* and second 121*b* opposing ends. The second surface 121*j* of first arm 121 includes recessed groove 121*k* near the center region 121*c* of the arm 121 and recessed end groove 121*m* near the second end 121*b* of the first arm 121. The first arm 121 is pivotably attached to a second arm 122. The second arm 122 includes opposite facing first 122*i* and second 122*j* surfaces, and first 122*a* and second 122*b* opposing ends. The first surface 122*i* of second arm 122 includes recessed groove 122*k* near the center region 122*c* of the arm 122 and recessed end groove 122*m* near the second end 122*b* of the second arm 122. The first arm 121 is attached to the second arm 122 at a point that is near the center region 121*c* of the first arm 121 and the center 122*c* of the second arm 122. The first arm 121 is also pivotably connected to a third arm 123. The third arm 123 includes opposite facing first 123*i* and second 123*j* surfaces, and first 123*a* and second 123*b* opposing ends. The first surface 123*i* of third arm 123 includes recessed groove 123*k* near the center region 123*c* of the arm 123 and recessed end groove 123*m* near the first end 123*a* of the arm 123. The first arm 121 is pivotably attached to the third arm 123 at a point that is near the second end 121*b* of the first arm 121 and the first end 123*a* of the third arm 123.

The second arm 122 is also pivotably attached to a fourth arm 124. The fourth arm 124 includes opposite facing first 124*i* and second 124*j* surfaces, and first 124*a* and second 124*b* opposing ends. The second surface 124*j* of fourth arm 124 includes recessed groove 124*k* near the center region 124*c* of the arm 124 and recessed end groove 124*m* near the first end 124*a* of the fourth arm 124. The second arm 122 is pivotably attached to the fourth arm 124 at a point that is near the second end 122*b* of the second arm 122 and near the first end 124*a* of the fourth arm 124. The fourth arm 124 is also pivotably attached to the third arm 123. The fourth arm 124 is pivotably attached to the third arm 123 at a point that is near the center region 124*c* of the fourth arm and the center region 123*c* of the third arm.

While a particular embodiment is shown in the figures, one having ordinary skill in the art should recognize that the recessed grooves or channels on arms 121–124 can be located on either the upper or lower surfaces, or on both surfaces, of the arms to provide clearance for the pivotal movement of one arm with respect to the other arm.

As seen in FIGS. 7A and 7B, the expansion and contraction means 120 of the device 85, in one embodiment, is attached to the upper plate 102 of yoke assembly 100 at points 125, 126. In response to movement in the expansion joint, the arms of the expansion and contraction means 120 pivot at pivot points 127–130 to expand or contract longitudinally in the expansion joint and to maintain a substantially equal distance between vehicular load bearing beams 11–17 and between the edge plates and side vehicular load bearing beams 11, 17.

Rollers 170*a*, 170*b* are attached to first end 121*a* of arm 121 by a roller pin and roller securement means. Washer and roller bearings may be fitted over opposite ends of roller pin to facilitate the sliding of rollers 170*a*, 170*b*.

Rollers 175*a*, 175*b* are attached to first end 122*a* of arm 122 by a roller pin and roller securement means. Washers and roller bearings may be fitted over opposite ends of roller pin to facilitate the sliding of rollers 175*a*, 175*b*.

Rollers 180*a*, 180*b* are attached to second end 123*b* of arm 123 by a roller pin and roller securement means. Washers and roller bearing may be fitted over opposite ends of roller pin to facilitate the sliding of rollers 180*a*, 180*b*.

Rollers 185*a*, 185*b* are attached to second end 124*b* of arm 124 by a roller pin and roller securement means. Washers and roller bearings may be fitted over opposite ends of roller pin to facilitate the sliding of rollers 185*a*, 185*b*.

Rollers 171, 173 disposed on the first surface 121*i* of arm 121, and are adapted to be slidably engaged with the transversely positioned load bearing members. Rollers 171, 173 are attached to arm 121 by pivot pins and roller securement means. Washers and roller bearings may be fitted over the pivot pins respectively to further facilitate low friction rolling of the expansion and contraction means.

Rollers 178, 179 disposed on the first surface 122*i* of arm 122, and are adapted to be slidably engaged with the transversely positioned load bearing members. Rollers 178, 179 are attached to arm 122 by pivot pins and roller plugs securement means. Washers and roller bearings may be fitted over the pivot pins to further facilitate low friction rolling of the expansion and contraction means.

Rollers 182, 183 disposed on the first surface 123*i* of arm 123, and are adapted to be slidably engaged with the transversely positioned vehicular load bearing members. Rollers 182, 183 are attached to arm 123 by pivot pins and roller securement means. Washers and roller bearings may be fitted over pivot pins to further facilitate low friction rolling of the expansion and contraction means.

Rollers 186, 187 disposed on the first surface 124*i* of arm 124, and are adapted to be slidably engaged with the transversely positioned vehicular load bearing members. Rollers 186, 187 are attached to arm 124 by pivot pins and roller securement means. Washers and roller bearings may be fitted over pivot pins to further facilitate low friction rolling of the expansion and contraction means.

Roller 172 is attached to the center regions 121*c*, 122*c* of arms 121 and 122 with a pivot pin and roller securement means. Washers and roller bearings may be fitted over the end of the pivot pin to further facilitate low friction rolling of the expansion and contraction means.

Roller 181 is attached to the center regions 123*c*, 124*c* of arms 123 and 124 with a pivot pin a and roller securement means. Washers and roller bearings may be fitted over the end of the pivot pin to further facilitate low friction rolling of the expansion and contraction means.

Rollers 174*a*, 174*b* are attached to arms 121 and 123 near the second end 121*b* of arm 121 and the first end 123*a* of arm 123 with a pivot pin and roller securement means. Washers and roller means may be fitted over the end of the pivot pin to further facilitate low friction rolling of the expansion and contraction means.

Rollers 176*a*, 176*b* are attached to arms 122 and 124 near the second end 122*b* of arm 122 and the first end 124*a* of arm 124 with of pivot pin and roller securement means. Washers and roller bearings may be fitted over the end of the pivot pin to further facilitate low friction rolling of the expansion and contraction means.

Figure 2:
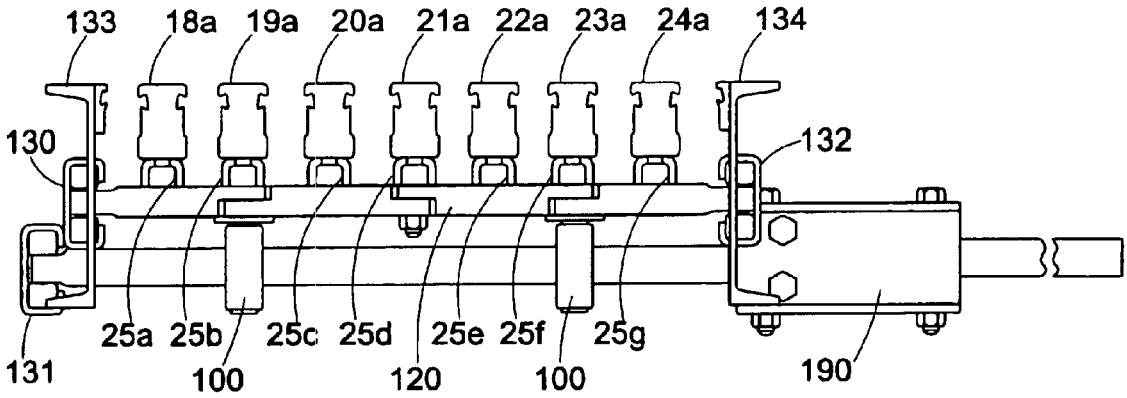
FIG. 2 is a cross-sectional view of a portion of the expansion joint system showing the means for controlling the spacing of the vehicular load bearing beams shown as being disposed below the vehicular load bearing beams.

According to one embodiment shown in FIG. 2, rollers 170, 175 are inserted into side guide 132 located in edge plate 134 and rollers 180, 185 are inserted into side guide 130 of edge plate 133. Rollers 182, 187 are inserted into 25*a* of vehicular load bearing beam 11. Roller 181 is inserted into guide 25*b* of vehicular load bearing beam 12. Rollers 183, 186 are inserted into guide 25*c* of vehicular load bearing beam 13. Rollers 174*a*, 176*a* are inserted into guide 25*d* of vehicular load bearing beam 14. Rollers 173, 178 are inserted into guide 25*e* of vehicular load bearing beam 15. Roller 172 is inserted into guide 25*f* of vehicular load bearing beam 16. Rollers 171, 179 are inserted into guide 25*g* of vehicular load bearing beam 17.

While one embodiment has been described as utilizing roller means engaged with arms 121–124, it should be appreciated that any mechanism having a sliding or rolling surface and which permits sliding or rolling engagement of the extension and contraction means 120 with the bottom surfaces of the load bearing beams 11–17 can be utilized in lieu of rollers. For example, a block or pin means may be used to provide sliding engagement of the expansion and contraction means with the load bearing beams.

If the gap in the expansion joint increases in response to movement within the joint, then the expansion and contraction means expands in the longitudinal direction relative to the flow of traffic to compensate for the increased distance within the expansion joint. To achieve this longitudinal expansion, the expansion and contraction means 120 simultaneously pivots at pivot points 127–130. During this pivoting, an angle formed between arm 121 and arm 122 decreases, an angle formed between arm 123 and arm 124 decreases, an angle formed between arm 121 and arm 123 increases and an angle formed between arm 122 and arm 124 increases.

Conversely, if the gap in the expansion joint decreases in response to movement within the joint, then the expansion and contraction means 120 contracts in a longitudinal direction relative to the flow of vehicular traffic to compensate for the decreased distance within the expansion joint. To achieve this, the expansion and contraction means 120 simultaneously pivots at pivot points 127–130. During this pivoting, an angle formed between arm 121 and arm 122 increases, an angle formed between arm 123 and arm 124 increases, an angle formed between arm 122 and arm and arm 124 decreases and an angle formed between arm 121 and arm 123 decreases.

FIG. 2 shows a cross sectional view of the expansion and contraction means 120 for controlling the spacing between the load bearing beams located in the expansion joint. FIG. 7B is a bottom view of the mechanism 120 of the expansion joint system 10 engaged with the bottom surfaces 18*b*–24*b* of the vehicular load bearing beams 11–17. Referring to FIG. 2, mechanism 120 of the expansion joint system 10 is engaged with the bottom surfaces of the vehicular load bearing beams 11–17, preferably by means of guides. Referring to FIG. 2, vehicular traffic load bearing beams 11–17 include the top vehicular load bearing surfaces 18*a*–24*a* and bottom surfaces 18*b*–24*b*. Guides 25*a*–25*g* are attached to the bottom surfaces 18*b*–24*b* of the vehicular load bearing beams 11–17. The guides 25*a*–25*g* are adapted to receive the roller means that are attached to the arms 121–124 of the expansion and contraction means 120 of the mechanism 85.

The expansion joint system 10 may include guides 130, 131 that are inserted into edge plate 133. Another guide 132 is inserted into edge plate 134. According to the embodiment shown in FIG. 2, the first end 121*a* of arm 121 and first end 122*a* of arm 122 are inserted into guide 132, which is inserted into edge plate 134. The second end 123*b* of arm 123 and the second end 124*b* of the arm 124 are inserted into guide 130, which is inserted in edge plate 133 of the expansion and contraction means 120. In response to movement within the expansion joint, the rollers that are attached to the ends of arms 121, 122 are free to slide within guide 132 and the rollers attached to the ends of arms 123, 124 are free to slide within guide 130. If the distance within the expansion joint increases, then the rollers slide within side guides 130, 132 toward the midline of the expansion and contraction means 120, thereby expanding the length of the expansion and contraction means in a longitudinal direction across the gap in the expansion joint. If the distance within the expansion joint decreases, then the rollers slide within the side guides 130, 132 in a direction away from the midline of the expansion and contraction means 120, thereby contracting the expansion and contraction means 120 in a longitudinal direction across the gap in the expansion joint.

In response to a thermal, seismic or vehicular event, the longitudinal movement of the mechanism of the expansion joint system, engaged with the load bearing beams, maintains a substantially equal distance between the load bearing beams 11–17 as the gap increases or decreases. As the rollers that are attached to the arms 121–124 of the expansion and contraction 120 means slide or roll within the guides 25*a*–25*g*, the load bearing beams 11–17 are pulled into relative alignment.

Still referring to FIG. 2, also embedded or inserted in edge plate is stabilizing bar side guide 131. The end 91 of the stabilizing bar 90 having the hole 93 with rollers 95*a*, 95*b* attached thereto is inserted into stabilizing bar side channel guide 131. In response to movement within the expansion joint, the rollers 95*a*, 95*b* that are attached to end 91 of the stabilizing bar 90 are free to move in a transverse direction within guide 131.

The expansion joint system of the invention is used in the gap between adjacent concrete roadway sections. The concrete is typically poured into the blockout portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

It is thus demonstrated that the present invention provides an improved expansion joint system that can accommodate expansion and contraction within an expansion joint that occurs in response to temperature changes, seismic cycling and deflections caused by vehicular loads. The expansion joint system of the present invention maintains a substantially equal distance between the transversely disposed vehicular load bearing beams of the expansion joint system. The use of a stabilizing bar in combination with an expansion and contraction means maintains proper positioning of the mechanism of the expansion joint systems and also supports the expansion and contraction means in the vertical direction within the expansion joint. The use of the roller system on the arms decreases the friction forces while still maintaining a proportional distance between the vehicular load bearing support beams.

While the present invention has been described above in connection with the preferred embodiments, as shown in the various figures, it is to be understood that other similar embodiments may be used or modifications and additions may be made to the described embodiments for performing the same function of the present invention without deviating therefrom. Further, all embodiments disclosed are not necessarily in the alternative, as various embodiments of the invention may be combined to provide the desired characteristics. Variations can be made by one having ordinary skill in the art without departing from the spirit and scope of the invention. Therefore, the present invention should not be limited to any single embodiment, but rather construed in breadth and scope in accordance with the recitation of the attached claims.

We claim:

1. An expansion joint system for roadway construction wherein a gap is defined between adjacent first and second roadway sections, said expansion joint system extending across said gap to permit vehicular traffic, said expansion joint system comprising:

a plurality of transversely extending, spaced-apart, load bearing members having top surfaces and bottom surfaces, wherein said top surfaces are adapted to support vehicular traffic;

at least one elongated support member having opposite ends extending longitudinally across said expansion joint from said first roadway section to said second roadway section, wherein said at least one support member is positioned below said transversely extending load bearing members;

at least one first means for accepting an end of said at least one longitudinally extending elongated support member, wherein said first means for accepting includes means for substantially restricting transverse movement within said at least one first means for accepting, but permitting longitudinal movement within said first means for accepting;

at least one second means for accepting an end of said at least one longitudinally extending elongated support member, wherein said second means for accepting include means for substantially restricting longitudinal movement within said second means for accepting, but permitting transverse and vertical movement within said second means for accepting, wherein said at least one elongated support member has one end located within said first means for accepting and the opposite end located in said second means for accepting; and at least one expansion and contraction means for controlling the spacing of said load bearing beams relative to one another comprising pivotably attached arms that are movably engaged with said load bearing members.

2. The expansion joint system of claim 1, comprising seals extending between said load bearing members.

3. The expansion joint system of claim 1, comprising seals extending between said load bearing members, and between said load bearing members and edge sections of said first and said second roadway sections.

4. The expansion joint system of claim 2, comprising means attached to each arm of said expansion and contraction means for engaging said load bearing beams.

5. The expansion joint system of claim 4, wherein said means for engaging is selection from one of roller means and pin means.

6. The expansion joint system of claim 1, comprising at least one assembly engaging said expansion and contraction means.

7. The expansion joint system of claim 6, wherein said assembly comprises a yoke assembly.

8. The expansion joint system of claim 7, wherein said yoke assembly slidably engages an elongated stabilizing member having opposite ends.

9. The device of claim 8, wherein said yoke assembly comprises bearings to permit longitudinal and vertical movement of said stabilizing member.

10. The device of claim 8, wherein the at least one yoke assembly is disposed between said expansion and contraction means and said stabilizing member.

11. The device of claim 10, wherein one of said opposite ends of said stabilizing member is adapted to be inserted into a means that permits transverse movement and substantially restricts longitudinal movement of said stabilizing member within said means for accepting.

12. The device of claim 11, wherein said end opposite of said end of said stabilizing member that is adapted to be inserted into said means that permits transverse movement and substantially restricts longitudinal movement is adapted to be inserted into a means that permits longitudinal movement and substantially restricts transverse movement of said stabilizing member within said means.

13. An expansion joint system for roadway construction wherein a gap is defined between adjacent first and second roadway sections, said expansion joint system extending across said gap to permit vehicular traffic, said system comprising:

a plurality of transversely extending, spaced-apart, load bearing members having top surfaces and bottom surfaces, wherein said top surfaces are adapted to support said vehicular traffic;

at least one elongated support member having opposite ends extending longitudinally across said expansion joint from said first roadway section to said second roadway section, wherein said at least one support member is positioned below said load bearing members;

at least one first means for accepting one of said opposite ends of said at least one support member, wherein said first means for accepting include means for substantially restricting transverse movement within said first means for accepting, but permitting longitudinal movement within said first means for accepting;

at least one second means for accepting an end of said at least one longitudinally extending elongated support members, wherein said second means for accepting include means for substantially restricting longitudinal movement within said second means for accepting, but permitting transverse and vertical movement within said second means for accepting, wherein said at least one elongated support member has one end located within said first means for accepting and the opposite end located in said second means for accepting; and at least one means positioned below said load bearing members and extending longitudinally across said expansion joint from said first roadway section to said second roadway section for controlling the distance between said load bearing members comprising:

a) an elongated stabilizing member having opposite ends, one of said opposite ends having roller means attached thereto, wherein said end having rollers means attached thereto is disposed within a first means for accepting said stabilizing member that permits transverse movement and substantially restricts longitudinal movement of the stabilizing member within said first means for accepting, said opposite end being disposed within a second means for accepting said ends of said stabilizing member that permits longitudinal movement and substantially restricts transverse movement of the stabilizing member within said second means for accepting;

b) at least one yoke assembly in movable engagement with said stabilizing member; and c) an expansion and contraction means positioned above said stabilizing member and above said least one yoke assembly, wherein said expansion and contraction means is attached to said at least one yoke assembly, and wherein said expansion and contraction means includes a plurality of pivotably attached arms, each arm including a plurality of roller means attached thereto and movably engaging at least two of said load bearing members.

14. The expansion joint system of claim 13, wherein said means for controlling the spacing between said load bearing members maintains a substantially equal distance between said load bearing members.

15. The expansion joint system of claim 13, comprising seals extending between said load bearing members.

16. The expansion joint system of claim 13, comprising seals extending between said load bearing members and between said beams and edge sections of said first and said second roadway sections.

17. An expansion joint system for roadway construction wherein a gap is defined between adjacent first and second roadway sections, said expansion joint system extending across said gap to permit vehicular traffic, said system comprising:

a plurality of transversely extending, spaced-apart, load bearing members having top surfaces and bottom surfaces, wherein said top surfaces are adapted to support said vehicular traffic;

at least one support member having opposite ends extending longitudinally across said expansion joint from said first roadway section to said second roadway section, wherein said at least one support member is positioned below said load bearing members, and wherein one end of at least one said support member has a hole therein;

at least one first means for accepting said support member, wherein said at least one elongated support member has one end located within said first means for accepting, and wherein said first means for accepting includes means for substantially restricting transverse movement within said first means for accepting, but permitting longitudinal movement within said first means for accepting;

at least one second means for accepting said support, wherein said at least one elongated support member having said hole therein is located within said second means for accepting, wherein said second means for accepting includes means for substantially restricting longitudinal movement within said second means for accepting, but permitting transverse and vertical movement within said second means for accepting; said means for permitting transverse and vertical movement comprising a) a guide member disposed within said second means for accepting, said guide member being inserted through said hole in said support member, b) first support bearings disposed adjacent to upper and lower surfaces of said support members, c) second upper and lower support bearings disposed adjacent to said second means for accepting, and d) upper and lower retaining members secured to said second means for accepting said support members for securing said second support bearings; and at least one expansion and contraction means including pivotably attached arms movably engaged with said load bearing members.

18. The expansion joint system of claim 17, wherein said first support bearings have at least one curved surface.

19. The expansion joint system of claim 17, wherein said second upper and lower support bearings have a curved surfaces mated with said curved surfaces of said first support bearings.

20. The expansion joint system of claim 17, wherein said arms of said expansion and contraction means are movably engaged with said load bearing members by one of a pin or roller means.

21. The expansion joint system of claim 17, further comprising a yoke assembly movably engaging an elongated stabilizing member having opposite ends.

22. The device of claim 21, wherein said yoke assembly comprises bearings to permit longitudinal and vertical movement of said stabilizing member.

23. The device of claim 21, wherein said at least one yoke assembly is disposed between said expansion and contraction means and said stabilizing member.

24. The device of claim 23, wherein one of said opposite ends of said stabilizing member is adapted to be inserted into a means for accepting said stabilizing member that permits transverse movement and substantially restricts longitudinal movement of said stabilizing member within said means for accepting said stabilizing member.

25. The device of claim 24, wherein said end opposite of said end of said stabilizing member that is adapted to be inserted into said means that permits transverse movement and substantially restricts longitudinal movement is adapted to be inserted into a means for accepting said end of said stabilizing member that permits longitudinal movement and substantially restricts transverse movement of said stabilizing member within said means for accepting.

26. The expansion joint system of claim 17, comprising seals extending between said load bearing members.

27. The expansion joint system of claim 17, comprising seals extending between said load bearing members and between said beams and edge sections of said first and said second roadway sections.

* * * * *